US008149177B1

(12) United States Patent
Callus et al.

(10) Patent No.: US 8,149,177 B1
(45) Date of Patent: Apr. 3, 2012

(54) SLOTTED WAVEGUIDE ANTENNA STIFFENED STRUCTURE

(75) Inventors: Paul J. Callus, Elwood Vic (AU); John D. C. de LaHarpe, London, OH (US); James M. Tuss, Centerville, OH (US); William G. Baron, Springfield, OH (US); David G. Kuhl, Kettering, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 362 days.

(21) Appl. No.: 12/435,603

(22) Filed: May 5, 2009

Related U.S. Application Data

(60) Provisional application No. 61/051,715, filed on May 9, 2008.

(51) Int. Cl.
*H01Q 1/42* (2006.01)

(52) U.S. Cl. ..... 343/771; 343/705; 343/770

(58) Field of Classification Search ..... 343/705, 343/708, 767, 770, 771
See application file for complete search history.

(56) References Cited

U.S. PATENT DOCUMENTS

| | | | | | |
|---|---|---|---|---|---|
| 3,413,640 | A | * | 11/1968 | Freeman et al. | 343/771 |
| 3,478,353 | A | * | 11/1969 | Adams, Jr. | 343/708 |
| 3,696,433 | A | * | 10/1972 | Killion et al. | 343/770 |
| 4,517,571 | A | * | 5/1985 | Mulliner et al. | 343/771 |
| 4,939,527 | A | * | 7/1990 | Lamberty et al. | 343/771 |
| 5,184,141 | A | * | 2/1993 | Connolly et al. | 343/705 |
| 5,757,329 | A | * | 5/1998 | Hoover et al. | 343/770 |

* cited by examiner

*Primary Examiner* — Tho G Phan
(74) *Attorney, Agent, or Firm* — Rebecca Greendyke; AFMCLO/JAZ

(57) ABSTRACT

A slotted waveguide antenna stiffened structure for an aircraft having an aircraft skin. The slotted waveguide antenna stiffening structure including a structural stiffening element reinforcing the aircraft skin; the structural element connected to a radio frequency feed source, the source providing energy with electromagnetic bandwidth to a slotted waveguide antenna having a plurality of slots. The antenna conformal to the aircraft skin and the structural stiffening element, the structural stiffening elements functioning as waveguides for the electromagnetic bandwidth. The slots may include a slot sealant enclosing the plurality of slots.

18 Claims, 8 Drawing Sheets

Azimuth Pattern Gain Display
(dBi)

Elevation Pattern Gain Display
(dBi)

SLOTTED WAVEGUIDE ANTENNA STIFFENED STRUCTURE

This application claims the benefit of provisional application 61/051,715 filed May 9, 2008 under the provisions of 35 U.S.C. §119(e).

RIGHTS OF THE GOVERNMENT

The invention described herein may be manufactured and used by or for the Government of the United States for all governmental purposes without the payment of any royalty.

BACKGROUND OF THE INVENTION

The invention relates to an air vehicle concept that simultaneously provides a load bearing and antenna function, herein referred to as a Slotted Waveguide Antenna Stiffened Structure (SWASS) concept. SWASS uses airframe construction, such as hat shaped cross-section stiffened skins, or sandwich stiffened structure skin made from materials such as carbon fiber reinforced composites or aluminum. SWASS uses slot apertures in the skin as RF radiators and the top-hat stiffeners for both structural reinforcement and also as waveguides to feed the slot apertures. In this way, with minimal changes to load bearing skin configuration, these skins may also become RF apertures. This invention provides an opportunity to incorporate extremely large RF arrays in airborne vehicles by making the wing and/or fuselage skins function as antennas, with minimal weight impact to the air vehicle system.

The invention is an important breakthrough that merges high performance aircraft composite structure technology with high performance radio frequency (RF) slotted waveguide technology in a totally unique and novel concept. This concept is a marriage of two distinct and diverse technology areas. The SWASS concept offers a major improvement in several performance parameters for airborne RF apertures because the antenna is also a high performance structure. The SWASS concept will enable apertures of unprecedented size which offers the potential for major improvements in RF system performance. The SWASS concept allows integration of RI apertures in locations such as wing/fuselage skins and empennage structure that are impossible or prohibitively impractical for conventional non-structural slotted waveguides enabling unprecedented fields of view which may be important for future airborne RF systems. The SWASS concept is inherently low cost as it reduces the weight and part count needed for integration.

The Air Force has a long-term vision to develop Battlespace Total Situational Awareness and Information Dominance for maximum strategic and tactical advantage over any potential adversary. This vision requires an extensive radio frequency (RF) antenna suite to perform radar, surveillance, electronic warfare, data link, communication, navigation, and identification functions. Current antenna installations are limited to parasitic and non-load bearing installations inhibiting preferred vehicle integration locations and antenna size. This invention provides application opportunity to most Air Force air vehicle systems. This includes small uninhabited air systems, small surveillance aircraft, fighter aircraft and large transport aircraft. The ability to put very large antennas on relatively small aircraft will provide in theatre surveillance and reconnaissance operations from relatively inexpensive aircraft. This invention concept is applicable to a wide variety of frequencies and may be limited at lower frequencies by the large size of the waveguide required. This invention further has potential for broad application on commercial transport systems such as automobiles, trucks, buses, aircraft, boats, yachts, and ships. These applications may be driven by the need for electromagnetic data links that provide a wide variety of safety, logistics, and entertainment information. The nature of this invention may facilitate conformal integration directly into the structure of commercial vehicles in the same fundamental manner as the invention will be integrated into Air Force air vehicles.

SUMMARY OF THE INVENTION

A slotted waveguide antenna stiffening structure for an aircraft having an aircraft skin. The slotted waveguide antenna stiffening structure including a structural stiffening element reinforcing the aircraft skin; the structural element connected to a radio frequency feed source, the source providing energy with electromagnetic bandwidth to a slotted waveguide antenna having a plurality of slots. The antenna conformal to the aircraft skin and the structural stiffening element, the structural stiffening elements functioning as waveguides for the electromagnetic bandwidth. The slots may have a slot sealant enclosing the plurality of slots.

A slotted waveguide antenna stiffening structure for an aircraft having a conductive aircraft skin. The slotted waveguide antenna stiffening structure including a structural stiffening element reinforcing the aircraft skin. The structural element connected to a radio frequency feed source, the source providing energy with electromagnetic bandwidth to a slotted waveguide antenna having a plurality of slots. The antenna conformal to the aircraft skin and the structural stiffening element, the structural stiffening elements functioning as waveguides for the electromagnetic bandwidth. In one embodiment, a slot sealant encloses the plurality of slots. The slot sealant is preferably a low-loss dielectric that allows efficient radiation of radio frequency energy. Many RF sensor systems can be carried by a single aircraft and the resulting combined antenna weight and size may reduce vehicle performance in the areas of speed, range, endurance and payload. The present invention improves operational effectiveness and performance of the aircraft. This is accomplished by replacing heavy/bulky antennas with lightweight/conformal antennas that have been incorporated into the airframe structure as claimed and disclosed herein.

DETAILED DESCRIPTION

The antennas for some RF systems are relatively heavy/bulky and therefore may degrade the speed, range, endurance and payload of aircraft. It is proposed herein that some performance may be restored by replacing such antennas with lightweight conformal antennas that function as airframe structure. This concept may be particularly advantageous for Small Uninhabited Aerial Vehicles (SUAVs) where weight and aerodynamic drag may significantly degrade performance. The weight of many RF antenna systems, including radars, signals intelligence receivers and jammers are now down to a few kilograms and may be carried as payloads in SUAVs. The advantages of SUAVs are that they can traverse battlefields within useful time periods, be networked, and replaced at relatively low cost. SUAVs fitted with appropriate systems can contribute significantly to the electronic warfare (EW) roles of jamming and suppression of enemy air defenses, electronic support measures and signals intelligence. Other RF functions including radar, communications, and data transmission may also be enabled or improved on SUAVs and other aircraft.

Figure 1A:
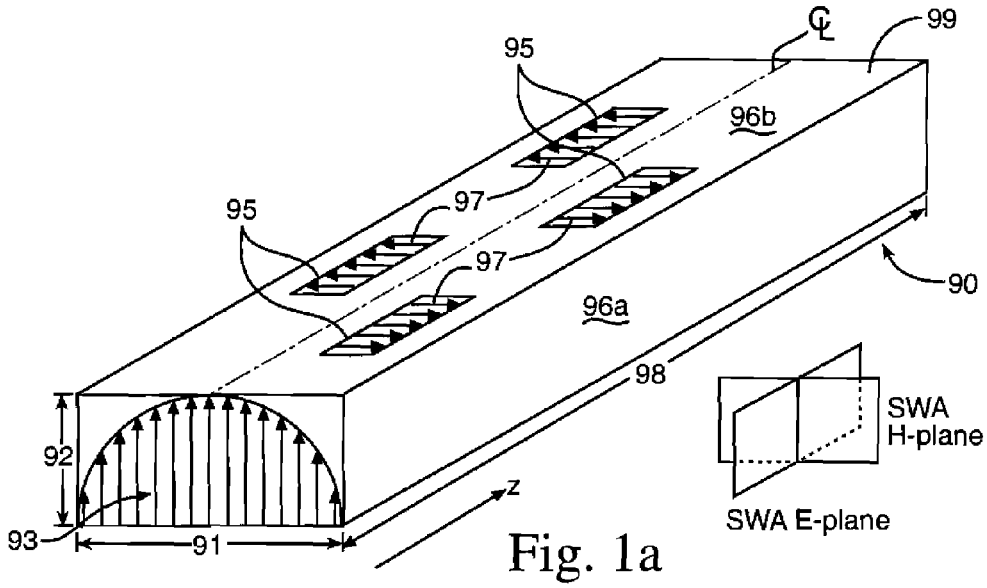
FIG. 1*a* is an illustration of a slotted waveguide antenna and E-fields.

As shown in FIG. 1*a* Slotted waveguide antenna 90 consists of a length 98 of electrically conducting tube 99 with four sides; long width sides 96*b* and short height sides 96*b*. The tube 99 has an internal width 91 and an internal height 92 such that radio frequency (RF) waves of particular frequencies will propagate along the waveguide 90 with little loss. The electric and magnetic fields of propagating waves have characteristic shapes that are known as propagating modes. In most slotted waveguide antenna applications excitation of only the fundamental $TE_{10}$ propagation mode is desired. If the cross-section of the tube is too small relative to the wavelength of the RF energy, then the $TE_{10}$ mode will not propagate. If the cross section of the tube is too large with respect to wavelength then unwanted higher order modes may be excited. The slotted waveguide antenna may also have a tubular cross-section or be multi-sided as shown in FIG. 1*a*.

FIG. 1*a* shows the cross-section of a $TE_{10}$ wave 93 in a slotted waveguide antenna (SWA) 90. An electric field vector of the wave is oriented perpendicularly to the width 91 of the waveguide. It has a half sine-wave profile across the width 91 of the waveguide with field strength of zero at the height sides 96*b* and maximum along a centerline ℄. At any particular point in time the profile of the E-field along the waveguide (z-direction in FIG. 1*a*) is sinusoidal with peaks and zeros at intervals of a half wavelength along the entire length of the waveguide. In contrast to the standing waves characteristic of shorted transmission lines, the $TE_{10}$ wave with its peaks and troughs propagates forward in the waveguide as a function of time.

As a result of this energy propagation there are time-varying electric (and associated magnetic) currents on walls 96*a* & 96*b* of the waveguide. Slots 95 cut into the sides 96*b* will disrupt the currents and create the indicated transverse electric fields 97. These fields will couple with the energy ($TE_{10}$ wave 93) inside the waveguide 90 and radiate it outside the waveguide 90.

Figure 1B:
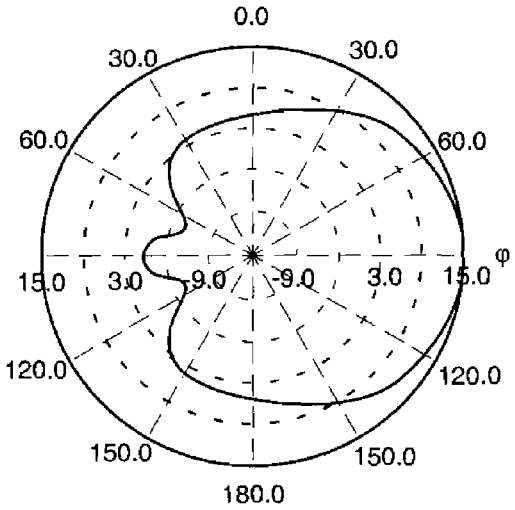
FIG. 1*b* is an illustration of an Azimuth pattern gain display (dBi).
Figure 1C:
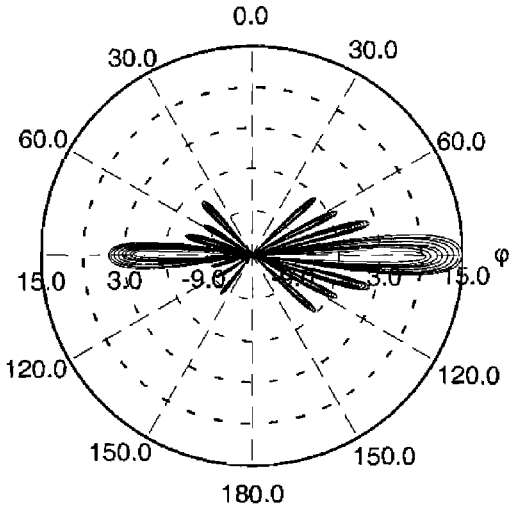
FIG. 1*c* is an illustration of an Elevation pattern gain display (dBi).

The typical SWA and its radiation pattern in the E- and H-planes are shown in FIG. 1*b* which shows one embodiment of an Azimuth Pattern Gain Display (dBi). For this antenna the E-plane passes through the centerline ℄ of the waveguide and is perpendicular to the side 96*a* of FIG. 1*a* face containing the slots 95 of FIG. 1*a*. The H-plane can be visualized as a cross-sectional view through the waveguide, one embodiment of which is shown in FIG. 1*c* which shows one embodiment of an Elevation Pattern Gain Display. Judicious positioning and sizing of the slots will maximize the efficiency of this energy transfer and control the direction and polarization of the radiated energy. Patterns may be tailored by changing the orientation and shape of the slots. For example the slots may be cut into the short wall 96*b* height 92 or circular polarization may be obtained by using cross-shaped slots.

Figure 10:
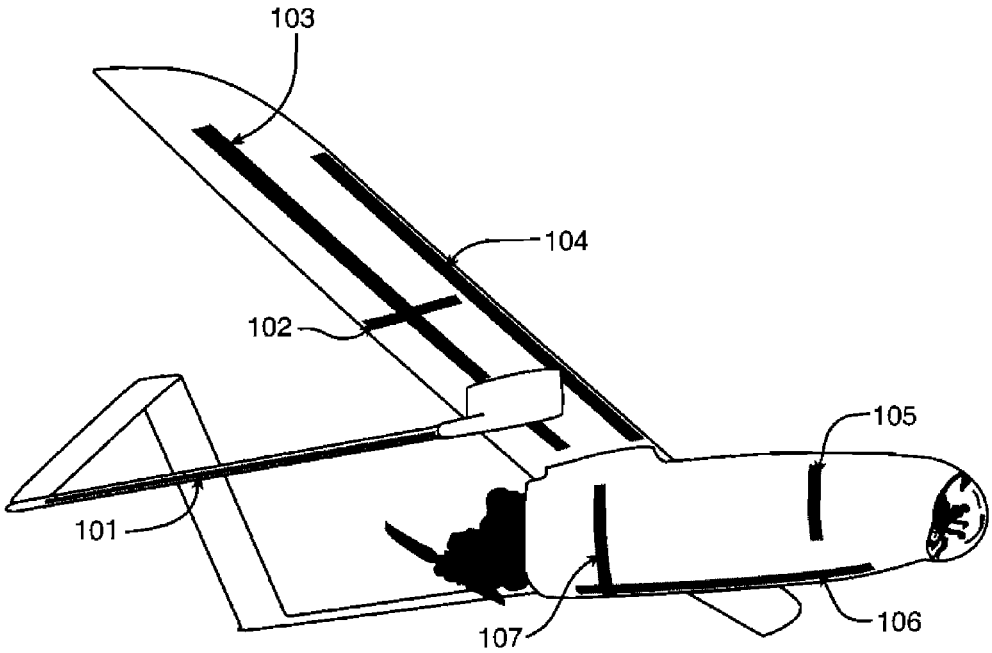
FIG. 10 is an illustration of alternative slotted waveguide antenna locations.

A major factor in determining the radiation pattern relative to the aircraft may be the location and orientation of the SWA on the aircraft. As shown in FIG. 10, there are a range of installation locations on aircraft 10 that may have varying effect over the resulting radiation pattern including tail boom 101, wing cord wise 102, wing span-wise 103, wing leading 104, vertical fuselage 105, longitudinal fuselage 106, wrap-around fuselage 107, or a combination thereof.

Figure 11A:
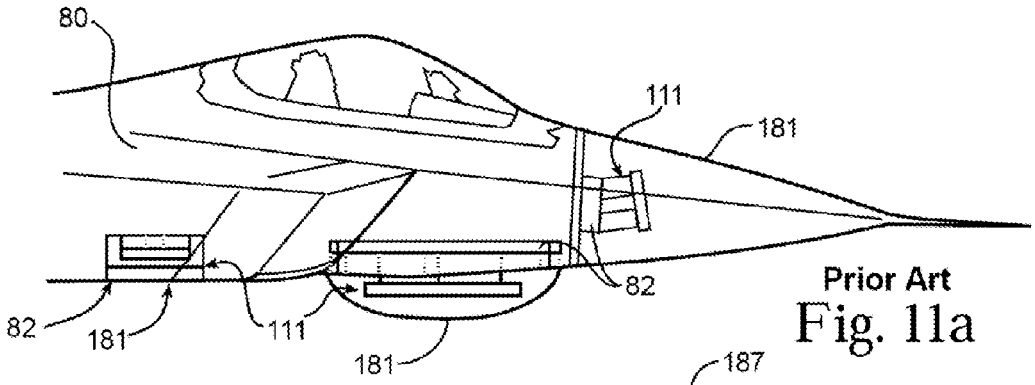
Prior Art Fig. 11a
FIG. 11*a* is an illustration of the prior art

The ability of SWASS to carry structural loads enables a broad range of installation options not available with conventional non-structural waveguides and antenna. As shown in FIG. 11*a*, conventional, non-structural waveguide antennas 111 may require support structure 82 and radomes 181. Support structure 82 is required to hold the waveguide and the radome, while also routing structural loads around the perimeter of the installation site. This approach is structurally inefficient and limits the options for antenna locations to sites where the structural arrangement can be accommodated. The support structure 82 adds significant weight and adds intrusive volume. In addition, protruding radome 181 installations may add aerodynamic drag to aircraft 80. These installation penalties reduce the range and payload of the air vehicle.

SWASS may include stiffened panels that replace stiffened structural skins. SWASS installations are designed to be conformal to the outer skin 80 of the aircraft and add no additional aerodynamic drag. SWASS panels can be installed across bays formed by airframe substructure or as a continuous skin over substructure. No support structure or radomes are required. The efficiency of SWASS installations provides opportunity for much larger antennas and allows antennas to be located on the vehicle for optimum field of view not limited by the ability of the structure to accommodate the installation.

Figure 11B:
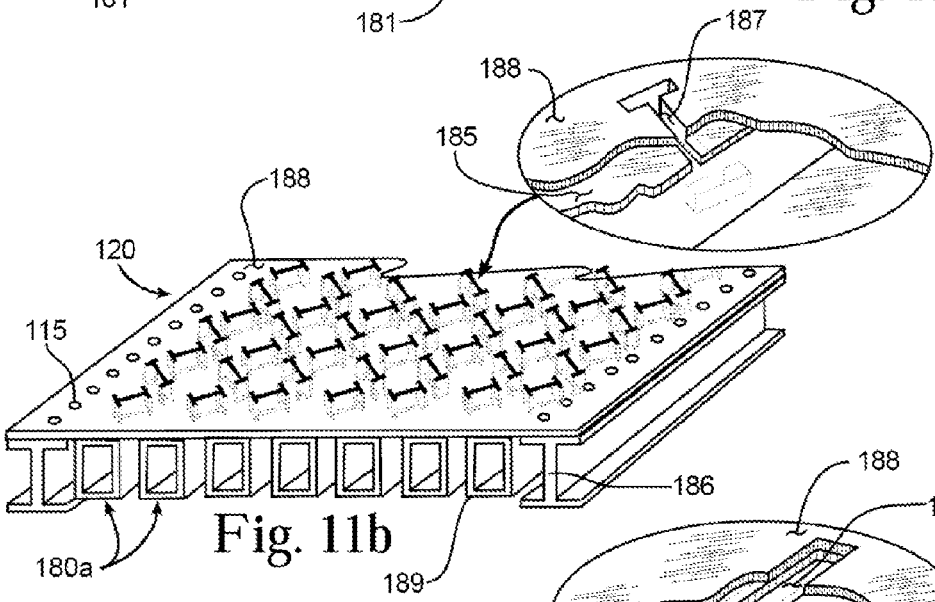
FIG. 11*b* and FIG. 11*c* are an illustration of alternative slotted waveguide designs.

As shown in FIG. 11*b*, slotted waveguide 120 may include stiffeners 180*a*, primary structure 186 and aircraft skin 188 with a stiffener skin side 185. Slots 187 extend through the aircraft skin 188 and the stiffener skin side 185. The skin 188 may be attached to the primary structure 186 by any means known in the art. FIG. 11*b* illustrates attachment with rivets 115. The skin 188 may similarly be attached by any means known in the art to the stiffeners 180*a*.

Figure 11C:
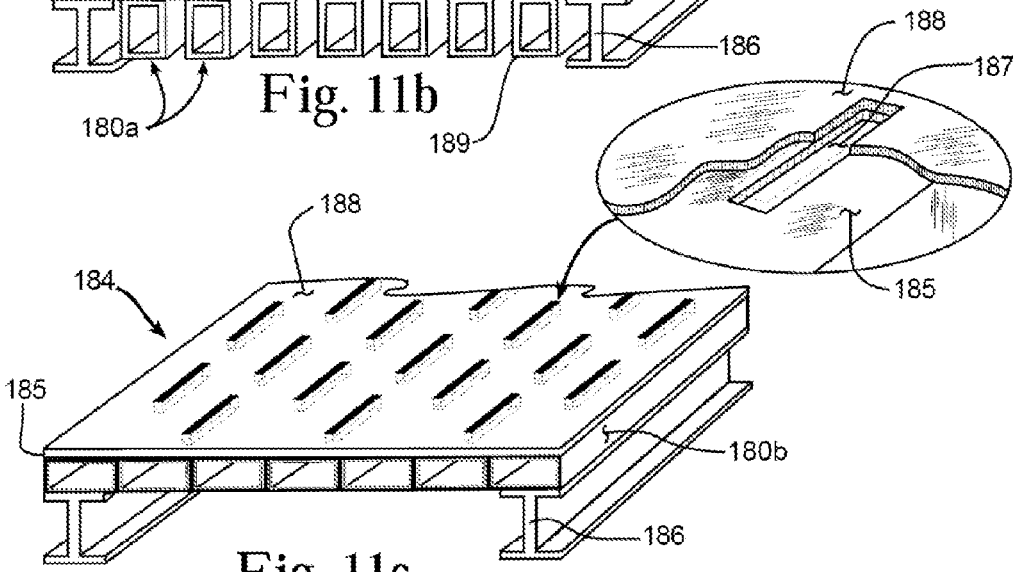

As illustrated in FIG. 11*c*, slotted waveguide 184 may include stiffeners 180*b* that either an integral component or abut one another. FIG. 11*c* also illustrates the stiffeners 180*b* inserted between the skin 188 and the primary structure 186. Slots 187 extend through the aircraft skin 188 and the stiffener skin side 185. The skin 188 may be attached to the stiffener primary structure 186 by any means known in the art. The skin 188 may similarly be attached by any means known in the art to the stiffeners 180*b*. Stiffeners 180*a* & 180*b* may be adjacent as illustrated in FIG. 11*c* or separate structures as shown in FIG. 11*b*. The stiffeners may be any size or different sizes. Stiffeners shapes other than rectangular are also contemplated such as multisided or curved perimeters.

The SWASS concept is devised as multifunctional aircraft structure for large, highly loaded, airframes where both the structural and electromagnetic requirements must be addressed.

Figure 8:
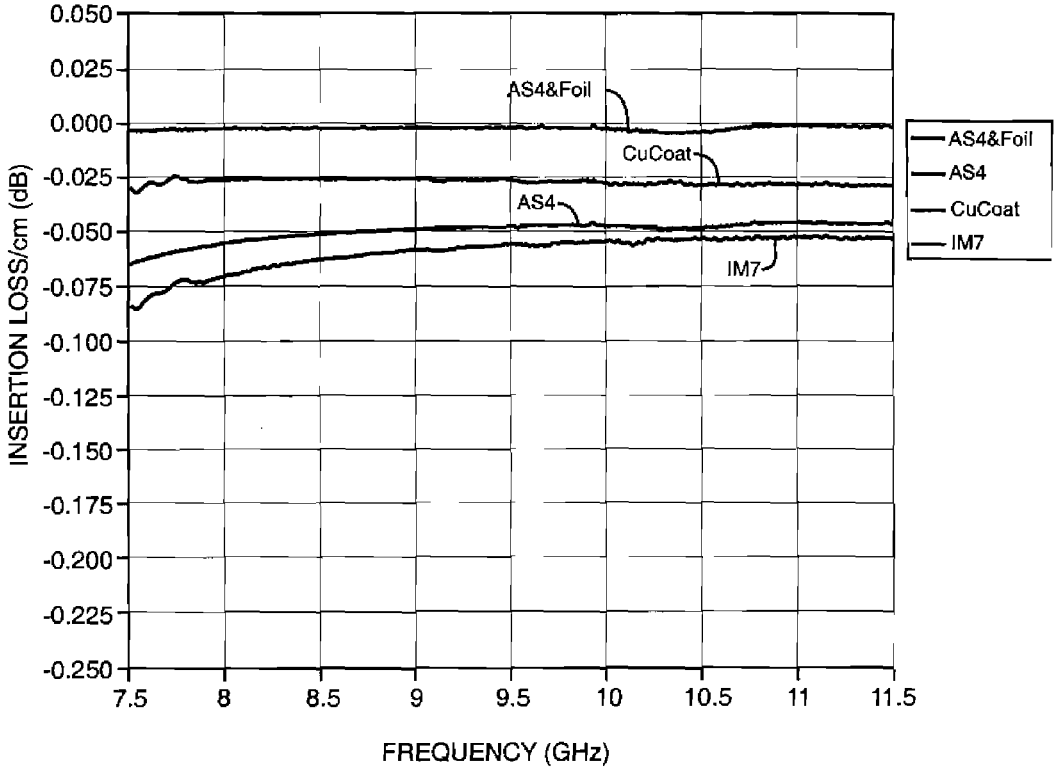
FIG. 8 is a graph of waveguide performance.

The conductivity of unidirectional CFRP is approximately $10^3$S $m^{-1}$ in the direction of the fibers and about 10 S $m^{-1}$ perpendicular to the fibers. Conductivity of multi-directional laminates is approximately $10^3$ S $m^{-1}$. The conductivity of metals are about three orders of magnitude greater ($\sigma_{copper}$=59×$10^6$ S $m^{-1}$, $\sigma_{aluminum}$=38×$10^6$ S $m^{-1}$ and $\sigma_{nickel}$=14×$10^6$ S $m^{-1}$). Testing, as shown in FIG. 8, shows that standard AS4-3501-6 (unidirectional carbon reinforced epoxy prepreg) may perform as a suitable structural waveguide material. If the conductivity of conventional CFRP is insufficient, one method of improving conductivity may be to use carbon fibers that have been metal coated. Carbon fibers coated with various conductive and low permeability metals are commercially available. If this is still found to be insufficient, then further increases in conductivity may be achieved by increasing the conductivity of the epoxy resin matrix one possible approach is to conducting fillers such as silver particles, carbon black, low loss metal microstrands, carbon nanotubes or carbon nanofibers, into the resin. In one embodiment copper coated carbon may be used as a structural waveguide material. Alternatively a conductive veil may be used to coat an inner mold line 29 (inner surface of the tube) of the tube as shown in FIG. 2*b*.

The thickness of typical CFRP aircraft skins range from about 0.5 mm up to about 25 mm. The variation in thickness within this skin, assuming no ply drop-offs, is on the order of 0.2 mm for unidirectional tapes and 0.4 mm for woven fabrics. Traditional ground planes for antennas are manufactured as a 10-40 μm thick layer of copper electrodeposited onto a flat dielectric substrate.

Figure 9:
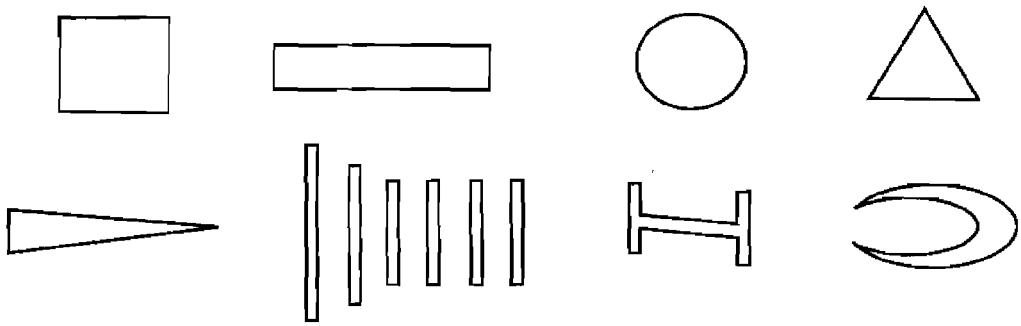
FIG. 9 is an example of slot shapes.

The optimal slot shape may be dictated by the balance between structural performance and the desired radiation pattern. The radiating slot may be any geometry including regular or irregular shapes provided it is properly located and oriented on the waveguide wall to disrupt surface current flow and thereby induce radiation of energy. Illustrative slot shape examples are shown in FIG. 9. The slot shape, size and orientation with respect to the waveguide walls are also a consideration for the structural performance of the SWASS. The structural performance and radiation performance must be traded to meet the needs of the application of interest. Rectangular and end-loaded "I" slots as shown in FIG. 9 have been designed, fabricated and tested for both electrical and structural properties in support of SWASS development efforts.

The upper limit on the size or number of radiating slots may be dictated by structural considerations. Preferably, the slot, or array of slots, would be incorporated into an airframe without additional reinforcement to the structure but without degrading structural integrity.

Aircraft structures are designed to support Design Ultimate Load. The creation of slots in the outer skin has the potential to reduce the strength of an aircraft structure below that required to support Design Ultimate Load. Ideally, the size of the slots in SWASS would be so small that the structure could still support Design Ultimate Load with no structural benefit attributed to the slot sealant of the antenna, i.e. the slot can be treated as an open hole for structural purposes. Generally, the upper limit on slot shapes, sizes and array geometries may be that combination which does not reduce compression strength below the design allowable. Larger slots than those described above may be acceptable; however, some reinforcement of the slot or the surrounding structure may be required. The lower limit on antenna size may be limited by the accuracy and tolerance of the manufacturing process. Composite aircraft skins may have a minimum feature size that could be reliably produced in an untrimmed hand laid-up part would be in the order of 10 mm. Low-precision machining would reduce this feature size to ≈1 mm, while precision machining would reduce it further to ≈0.5 mm. Precision machined metallic slots may be manufactured down to ≈0.2 mm in size.

In addition to the absolute size of the antenna it may be preferable to consider the tolerance on this size. Assuming, as a first approximation, that an antenna must be within 1% of the nominal size then it may be estimated that the tolerance on untrimmed manual laid-up slots in composite aircraft structure would be in the order of 2 mm. Low precision machining would be within about ±0.1 mm while high precision machining could produce slots within about ±0.03 mm. The tolerance on precision machined metal slots is estimated at about ±0.01 mm.

The final array configuration may be dictated at least in part by the required antenna characteristics and the size limitations. Antennas may vary from a single slot radiator, to a one-dimensional line of slots, to a two-dimensional array. A single slot-size may not be sufficiently broadband to cover the full range of frequencies of interest for military antennas. This may be partially overcome by using slots of different sizes.

Figure 2A:
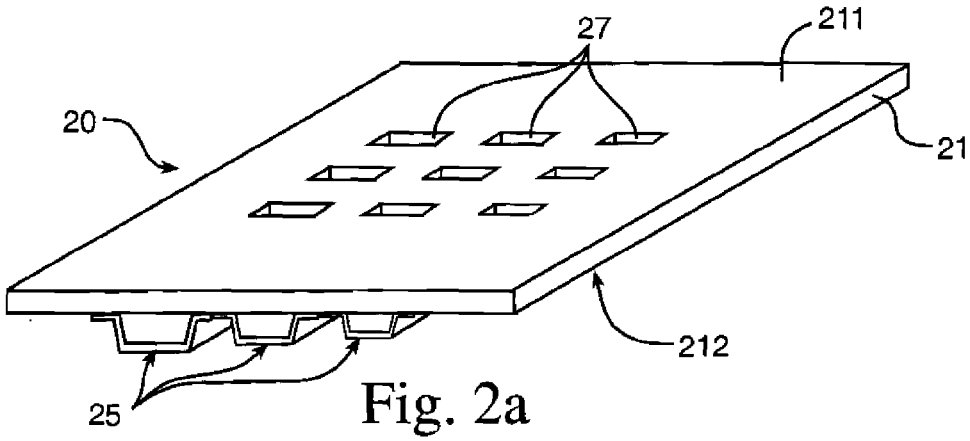
FIG. 2*a* is a 3-dimensional example of a slot array.
Figure 2B:
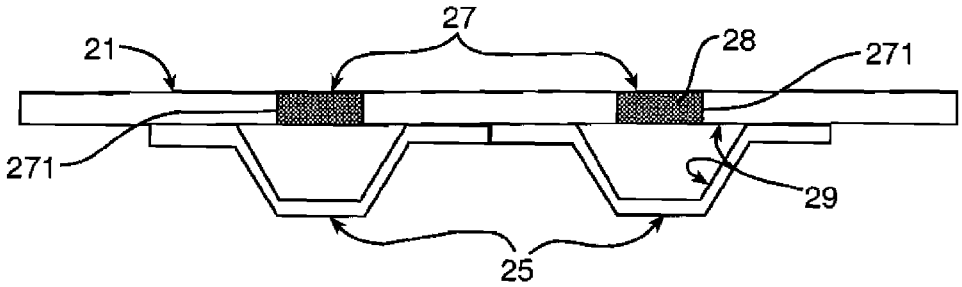
FIG. 2*b* is an end view of the stiffeners acting as waveguides.

As shown in FIGS. 2*a* and 2*b* a skin 21 and hat stiffeners 25 may act as slotted waveguide antenna array 20. The internal shape and dimensions of the hat 25 may be controlled so that it both stiffens and supports the skin 21 in addition to acting as a waveguide 20. The skin has a skin outer surface 211 and an inner surface 212. The slots 27 include slot walls 271 as shown in FIG. 2*b*. In one embodiment, the slots 27 are filled with a dielectric 28. Alternatively, at least a plurality of the slots is sealed with the dielectric 28. For some frequency bands the size of standard rectangular waveguides are of the same order as that of typical hat stiffeners. For example, the cross-section of WR-90 waveguides for use at frequencies near 10 GHz is about 22.86 mm×10.16 mm. Additional design freedom may be obtained by filling waveguides with a dielectric. This may extend the operating frequency of some waveguide while allowing their dimensions to be retained for structural purposes.

A known limitation of slotted waveguides is bandwidth. The efficiency of SWASS installations enables a practical opportunity to overcome this limitation where mission requirements dictate. Aircraft skins offer the potential for large surfaces on which to install antennas for a wide range of frequencies without physical interference from each other. SWASS panels of complimentary bandwidths can be arrayed without the weight and volume penalties which make such an approach prohibitive with conventional non-structural slotted waveguide antennas.

In some applications a single RF aperture supporting multiple frequency band operation is desirable. One embodiment is to implement this capability utilizing slotted waveguide radiators is to interleave waveguides and slots designed for one band of frequency among those designed for different frequencies.

Radiating slot separation in an SWA tends to be of the same order as slot size which are both related to the electrical wavelength. In one embodiment, there may be enough difference in the wavelength of each frequency band for that this characteristic allows sufficient space between the radiators for one frequency band to accommodate the radiators for the higher frequency band.

Figure 3:
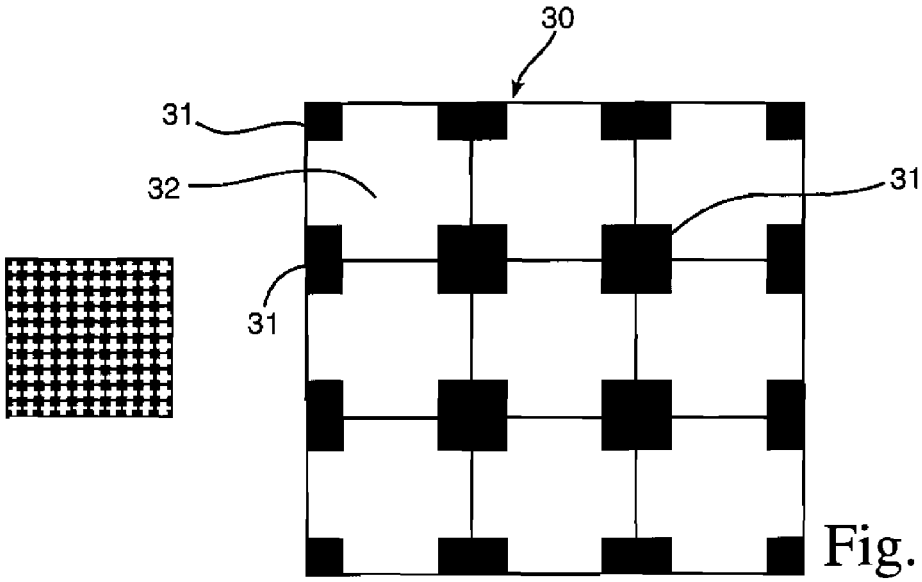
FIG. 3 is an illustration of one node and simulated slot radiators.

As shown in FIG. 3, a large bandwidth may be designed such that almost all of the radiators 31 of a 10×10 array 30 for a high frequency (short wavelength) array will fit in a space 32 between two adjacent radiators 31 in the low frequency (long wavelength) array.

It may be preferable to fill or coat a plurality of the slots with dielectric material, producing a dielectric window. The dielectric may be a polymer resin. In one embodiment, the dielectric has a modulus similar to that of the surrounding structure. A low modulus slot sealant may allow the window to deform with the skin, while remaining bonded to the slot walls 271 (as shown in FIG. 2*b*). The dielectrics may be manufactured from any material known in the art including glass fiber reinforced polymer or quartz fiber reinforced polymer. There are a number of approaches to incorporate a glass or quartz composite stiffened window into a CFRP skin.

Figure 4:
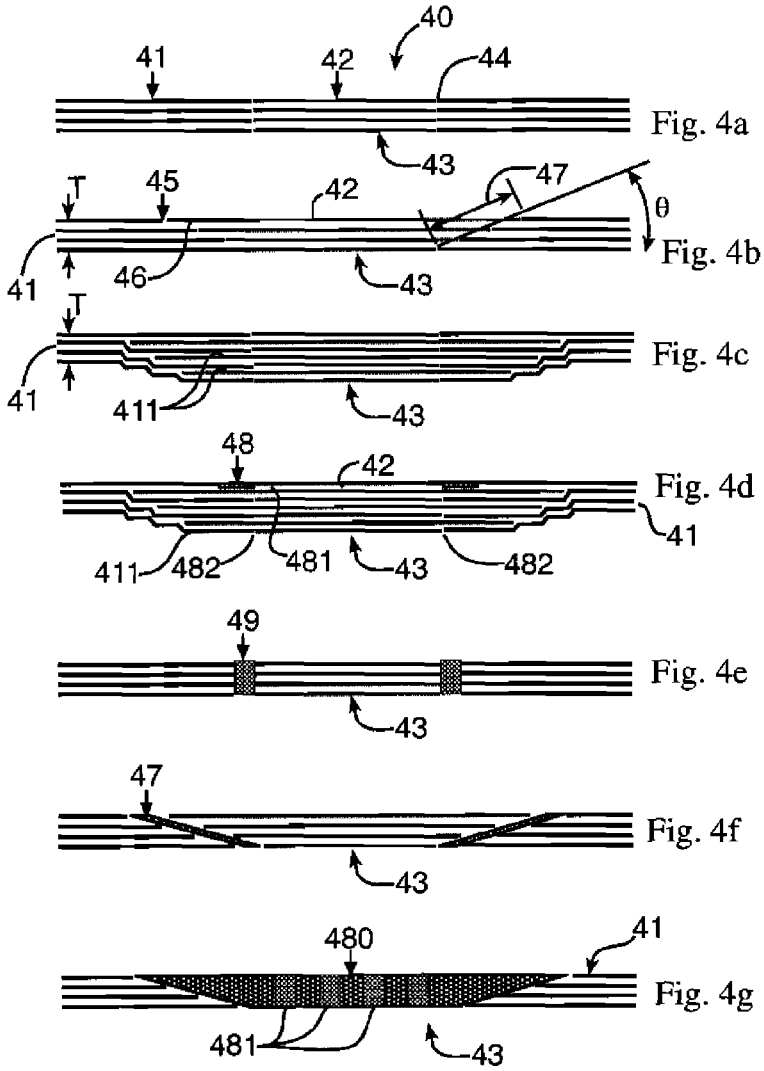
FIGS. 4*a* through 4*g* are various alternative cross-sections of dielectric window embodiments.

The dielectric constant (or permittivity) and loss tangent (or dissipation factor) of the sealant are preferably taken into consideration during electrical design of the radiating slot as these parameters may have a significant influence on antenna performance. FIGS. 4*a* through 4*g* show alternatives for combining CFRP 41 with glass or quartz composite 42 to form a dielectric window 43. One alternative shown in FIG. 4*a* shows a lay-up of a glass or quartz composite window 40 into a straight-sided window 44. This may be done with a slot machined into a precured skin or with the slot cut into the un-cured skin plies. The load bearing capability of such a straight sided window 44 would be very low. In-plane loads in the CFRP 41 (skin) would produce axial stresses across the skin/window interface. The modulus of glass or quartz composite is less than CFRP, allowing the window to accommodate much larger deformations than the skin; however, without fiber bridging across the slot the load carrying capability would be reduced.

The load bearing capacity of the window 43 may be improved substantially by a scarf joint 45 as show in FIG. 4*b* providing angled sides for bonding the glass or quartz stiffened composite. The window 43 could be manufactured by laying up into a scarfed slot 46 machined into cured CFRP 41 (skin) or stepped cut-outs in uncured CFRP 41 (skin) plies. A scarf angle θ required to obtain good load transfer between the composite materials and adhesives commonly used in modern aircraft structures is approximately from about 2 degrees to about 5 degrees. This produces a scarf length 47 to skin thickness T ratio of close to 20:1 (20 mm of scarf width of every mm of skin thickness), which can become very large with only modest increases in slot size or skin thickness.

In one embodiment the load transfer may be achieved by interleaving the window 43 and skin plies 411 as shown in FIG. 4*c*. Interleaving may be performed with uncured prepregs or dry fiber preforms. The disadvantage of this technique is the relatively poor control on window size because no post-cure machining can be performed. This may be acceptable for lower frequency antennas but may not be suitable for higher frequency designs where manufacturing tolerances approach a significant percentage of the electrical wavelength dimension.

The thickness T (FIG. 4*b*) of the skin 41 may increase in the region of the window 43 and this would need to be accounted for in the waveguide stiffeners located on the back-face. Closer control on slot size may be achieved by producing an oversized window and using a thin metallic bushing 48 as shown in FIG. 4*d*. The metallic bushing 48 preferably has an inner edge 481 which is preferably machined to about the thickness of the skin plies 411 as shown in FIG. 4*d*. The thin bushing 48 may be inserted anywhere on the ply 411 but preferably on an outer edge 482 near the window 43. A full-thickness, straight sided, bushing 49 around the window 43 shown in FIG. 4*e* may be easier to manufacture but the load bearing capacity of this configuration may be no better than the embodiment as shown in FIG. 4*a*.

A tapered bushing 47 configuration shown in FIG. 4*f* to form window 43 may have both the close tolerance of precision machined metal bushings and good load transfer characteristic of scarf joints. In addition, the skin would not thicken around the window 43 as it did with the interleaved ply scheme shown in FIG. 4*d*. However, these bushings may be quite large for thick skins. For very small slots it may be easier to machine the entire array 481 into a single metal plate 480, then bond the plate 480 into the skin 41, as shown in FIG. 4*g*.

Figure 5A:
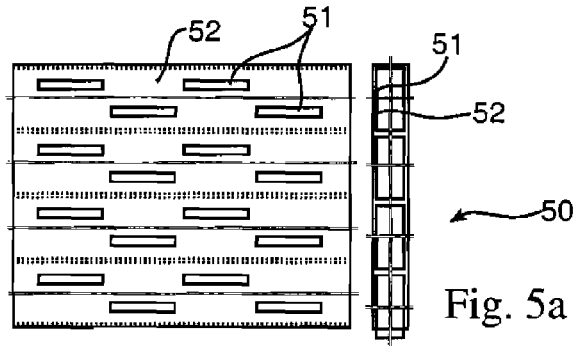
FIG. 5*a* is one embodiment of a sandwich stiffened panel.
Figure 5B:
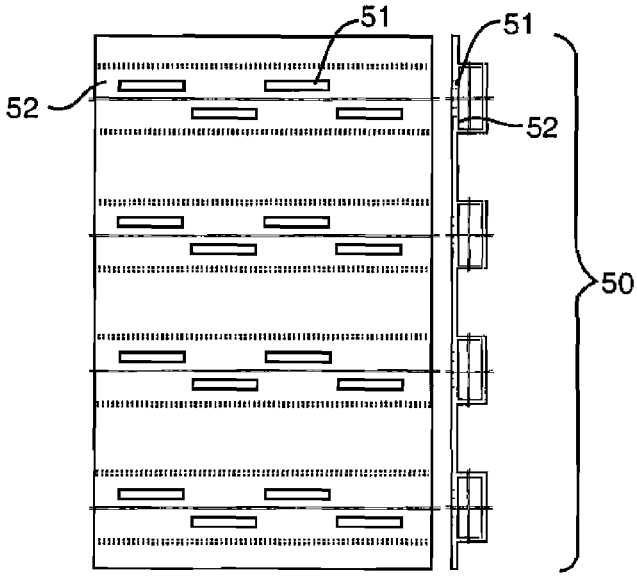
FIG. 5*b* is one embodiment of a hat stiffened skin panel.
Figure 6C:
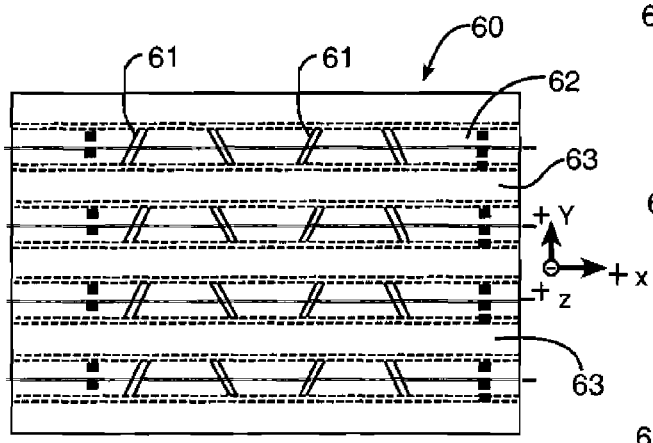
FIG. 6 is one embodiment of a hat stiffened skin with inclined slots on the narrow walls.
Figure 6A:
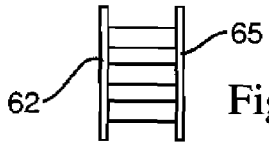
Figure 6B:
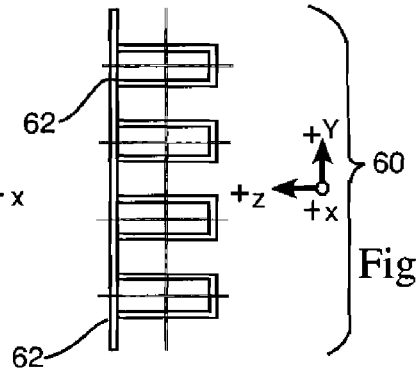

Possible SWASS embodiments are shown in FIGS. 5 and 6. In FIG. 5*a* and FIG. 5*b* slots 51 are on broad-walls 52 of the waveguides 50 whereas in FIG. 6*a* and FIG. 6*b* the slots 61 are on a narrow-wall 62 of waveguide 60. The latter are called edge-slot arrays. The spacing of the waveguides with the narrow-walls contacting each-other, allows the lateral distance between the slots (perpendicular to waveguide longitudinal axis) to be less than ½ of the electrical wavelength. This is important because a larger spacing, such as that shown in FIG. 5*b*, may produce grating lobes in the radiation field. It is possible that the effect of grating lobes may be compensated for by using very large numbers of radiating slots. SWASS offers the possibility of very large numbers (many hundreds or thousands) of radiating slots because aircraft skins tend to occupy much larger surface areas than traditional waveguide arrays. The structural stiffness of the configuration shown in FIG. 5*a* is an alternative stiffening method to honeycomb sandwich or hat stiffened panels. The waveguide broad-walls 52 are analogous to the face-sheets, supporting axial, bending and in-plane shear loads, while the narrow-walls 62 and 65 in FIG. 6*a* would transfer a plurality of the load between the face-sheets, preventing these outer skins from buckling.

The structural efficiency of the hat stiffened skin shown in FIG. 5*b* would be less than that of FIG. 5*a*; however, this design may be sufficiently stiff for it to be used in many airframe applications, particularly those subjected primarily to in-plane axial loads. Additionally, the arrangement in FIG. 5*b* could lead to large spacing between the rows of slots, and the presence of grating lobes. The major disadvantage with the layout shown in FIG. 5*a* is that traditional broad-wall slots almost overlap, producing an effective discontinuity across the entire length of the slot array. When loaded perpendicular to this discontinuity, the load that the slotted waveguide could support may be substantially lower than that for the unslotted structure. An alternative, shown in FIG. 6*a* and FIG. 6*b*, is to use edge-slot arrays. The fractional area of skin cut by edge-slots is much lower than that in broad-wall slot arrays. This layout of waveguides would also permit a hat stiffened skin design to maintain the desired less than λ/2 wavelength separation between the rows of slots, rather than using the sandwich stiffened panel layout shown in FIG. 5*a*.

An inner face-sheet 65 as shown in FIG. 6*a* may be coplanar with an unslotted narrow wall portion 63, may be added where greater stiffness/strength is required. The resulting structure would be similar to that shown in FIG. 5*a*, but thicker in the z direction as shown in FIG. 6*a* and FIG. 6*b* and with an associated increase in bending stiffness. The operating frequency range for SWASS antennas may be controlled by the cross-sectional shape and dimensions of the waveguide stiffeners. Although waveguides with elliptical and circular cross-sections are commercially available, only standard rectangular section waveguides have been considered for SWASS applications at this stage because performance data is widely available and the waveguide cross-sections approximate that of hat stiffeners. Alternative hat cross sectional shapes such as circular, elliptical, or trapezoidal (sloping side-walls) may be designed to propagate electromagnetic (EM) waves efficiently.

Electromagnetic waves propagate within waveguides in discrete modes, with the mode number referring to the orientation of the electric and magnetic fields with respect to the waveguide dimensions. For most applications it is desired that the waveguide operate only with the dominant $TE_{10}$ mode because this mode maximizes energy transmission.

The minimum frequency that can propagate in a waveguide is called the cut-off frequency ($f_{co}$) and, for standard rectangular waveguides, is calculated using Equation 1. Although rectangular waveguides do operate in single $TE_{10}$ mode at frequencies from $f_{co}$-$2f_{co}$, the practical limits are from $1.25f_{co}$-$1.89f_{co}$. The recommended frequency range for WR90 waveguides, $f_{co}$=6.56 GHz, is 8.20-12.40 GHz, even though the waveguide will support single $TE_{10}$ mode propagation from 6.56-13.11 GHz.

$$f_{co} = \frac{c}{2a} \tag{1}$$

Where:

c=speed of light a=width of broad-wall

Standard rectangular waveguides are available for frequencies ranging from 100s of MHz through 100s of GHz. A reasonable range of stiffener heights suitable for SWASS may be from about ±12-100 mm. This roughly corresponds to standard waveguide heights encompassing the frequency range of 1.70-26.5 GHz. Thus, a reasonable first estimate for the possible frequency range of SWASS antennas is 1.70-26.5 GHz.

The practical frequency range for any single waveguide is about $1.25f_{co}$-$1.89f_{co}$. This equates to bandwidths of approximately 1.5:1 or 40%. The bandwidth for any particular SWASS antenna may be much smaller, on the order of 10%. However, the bandwidth of a component that contained a SWASS antenna array could be increased by varying the dimensions of slots within any single waveguide stiffener and/or using multiple waveguides with different dimensions in the component.

When designing a waveguide antenna with narrow wallslots of an electrically resonant perimeter length. It is preferable to know the relationship between slot conductance and susceptance for the particular combination of angle, width, waveguide dimensions and frequency. Resonant slots are in the order of $0.5\lambda_0$ ($\lambda_0$=free space wavelength=c/f) long. However the short narrow-walls of waveguides are only around $0.4\lambda_0$ long. Thus narrow-wall slots are usually extended by cutting through the narrow-wall and down into the broad-walls. The parameter called "slot depth" is half the difference between the required slot length and the length available for the slot on the narrow-wall. While it is acceptable to penetrate into the broad-wall in stand-alone waveguides, this is expected to be much less acceptable in SWASS waveguide stiffeners, due to reduced load carrying capability. Extending a slot into the broad-wall may require the removal of some of the outer skin to allow access for a cutting tool into this wall. This may further reduce the structural strength of the SWASS. Secondly, the slot extension in the broad-wall would direct some radiation against the back face of the outer skin. This excess radiation would need to be reflected or absorbed, increasing weight and complexity of the SWASS. Therefore it may be strongly desired that narrow-wall slots in SWASS designs be completely contained within the narrow-wall.

It may be predicted how changing the dielectric constant or permittivity ($\in_r$) of the material within a slot will change the impedance and resonant frequency of the slot. Further, it may be possible to develop techniques that reliably fill SWASS slots with material of different permittivity than that of the surrounding material. One possibility would be to machine slots in precured SWASS then cover the slots with an appliqué produced from a material with controlled $\in_r$.

The wavelength of RF energy propagating in a waveguide (known as guided wavelength) is not the same as that wave propagating in free space. Free space wavelength is given by the classical Equation 2 while guided wavelength in a rectangular waveguide is given by Equation 3.

$$\lambda_0 = \frac{c}{f} \tag{2}$$

$$\lambda_g \sqrt{\frac{1}{\left(\frac{1}{\lambda_0}\right)^2 \left(\frac{1}{\lambda_c}\right)^2}} \tag{3}$$

Figure 7A:
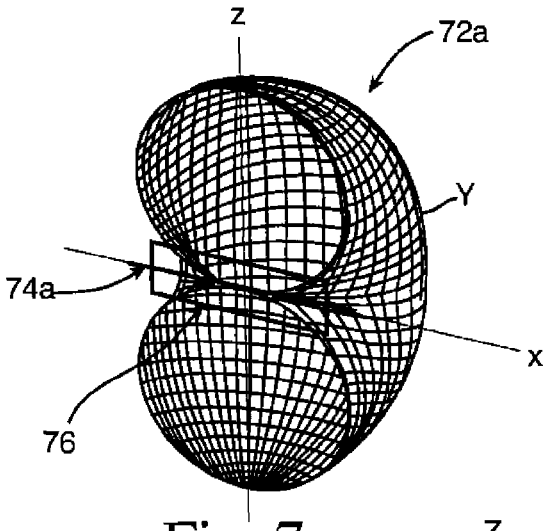
FIG. 7*a* is one embodiment of the radiation pattern of a single half wavelength dipole along the x-axis, sectioned along the x-z plane, and a slot in the x-y plane.

Where:

$\lambda_0$=wavelength in free space f=frequency $\lambda_g$ guided wavelength $\lambda_c$=2a where a is the width of the inside of the broad-wall FIG. 7*a* shows one half of the radiation pattern 72*a* for a half wavelength wire dipole 74*a* oriented along the x-axis with a slot infinite ground 76. A slot array 74*b* is a row of appropriately sized and located slots in a waveguide. Such an array modifies the pattern shown in FIG. 7*a* by reducing the width of the beam in the x-z plane, producing the disc shaped pattern 72*b*, illustrated in FIG. 7*b*. In general, the larger the area populated by the radiating slots, the narrower the resulting antenna beam (lower half power beam width (HPBW)) and the greater it's gain. The typical design process for a slot array in a waveguide focuses on calculating the number, location, dimension and orientation of slots that are required to produce the desired gain and HPBW in the main lobe while limiting the size and extent of sidelobes to an acceptable level.

Figure 7B:
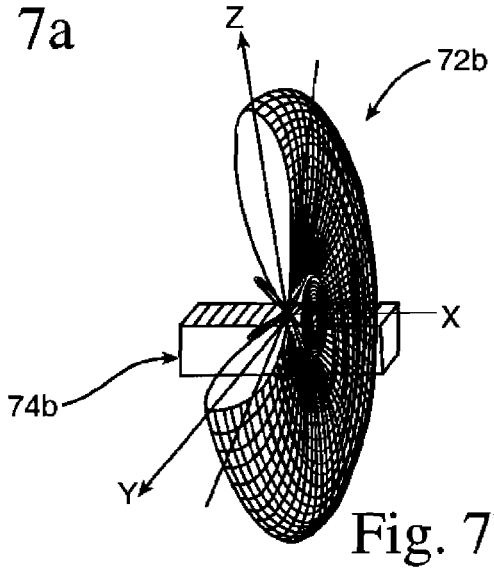
FIG. 7*b* is one embodiment of a row of slots oriented along the x-axis.
Figure 7C:
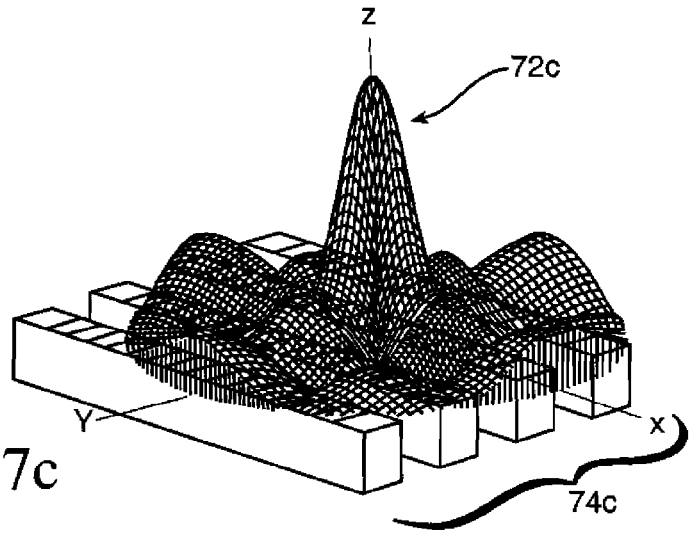
FIG. 7*c* is one embodiment of a planar array of slots in the x-y plane.

As illustrated in FIG. 7*c*, a planar array 74*c* may be created by extending the linear array from FIG. 7*b* in the transverse direction. This focuses the pattern in both directions to create a pencil beam 72*c*. In the case of FIG. 7*c*, the array is distributed over the x-y plane and the pencil beam 72*c* oriented in the z-direction.

Beam steering may be achieved by a coordinated variation of the phase between the waves incident at each slot in an array. If a planar array was fed through a single port that was manifolded into all of the waveguide stiffeners then the phase difference between each slot may be about constant and dictated by the relative length of waveguide between the feed and slot. Judicious selection of this length would produce a pencil beam oriented in the desired direction. Typically this would be broadside (z-axis in FIG. 6 and FIG. 7*c*) or end-fire (x-axis in FIG. 6 and FIG. 7*c*) but it could be in another direction. The width and gain of the beam may depend on the number of slots in the x-direction and waveguides in the y-direction of FIG. 7*c*. If each waveguide were fed individually then the phase in each waveguide may be varied independently and beam may be steered about the longitudinal axis of the waveguides (x-axis in FIG. 6 and FIG. 7*c*) but not the transverse axis (y-axis in FIG. 6 and FIG. 7*c*).

Steering about the transverse axis (y-axis in FIG. 6 and FIG. 7*c*) may require that the phase between adjacent slots within each of the waveguides be varied. The conventional approach to steering the beam about this axis would be to either (i) retain the staring beam and mechanically steer the entire array about this axis, or (ii) use a separate transmit/receive (T/R) module for each slot. Both of these add considerable weight and complexity to the antenna and neither are attractive alternatives for a SWASS application.

There are two exemplary approaches to produce full beam steering in SWASS. The first would be to produce SWASS components that contain multiple sub-arrays, each with a different (but fixed) beam angle about the transverse axis and steer about the longitudinal axis by controlling the phase between waveguides. This may be practicable for aircraft structures such as wing or fuselage skins because they have large surface areas. With tens of square meters (hundreds of square feet) available it may be practicable to produce many moderately sized sub-arrays, say a 10×10 array of 300×300 mm (1'×1') radiating banks each transmitting/receiving at a slightly different angle.

The second approach uses a varactor connected across each slot to control the phase radiated from that slot. A varactor is an electronic circuit element whose capacitance changes depending on the voltage applied to it. The capacitance would be controlled so that the slot radiates with a desired phase lag thereby allowing electronic control of the beam pointing angle.

SWASS waveguides may be used to support either standing or traveling waves. The former can be used to produce a resonant array while the latter is used as a travelling wave array. Standing waves are created by terminating the end of the waveguide in a solid conducting wall thereby creating a short circuit condition where guided energy incident upon this interface is reflected. This induces a condition where two waves are simultaneously propagating with equal magnitude but in opposite directions. The periodic constructive and destructive interference between these waves creates a resonant standing wave with alternating maximum and minimum magnitudes along the length of the waveguide. Judicious selection of the waveguide length, position of the end shorts and spacing of the slots will create the standing wave with so that maximum magnitude peaks are co-located with the radiating slot positions thereby delivering maximum power to the slots. Travelling waves are created by leaving the waveguide ends open or terminated in a matched load that absorbs any residual energy not radiated from the slots. If a travelling wave approach were chosen for SWASS it is likely that an absorber would be located beyond the last slot to prevent radiation from being transmitted into the surrounding structure.

Several methods exist for coupling energy to and from slotted waveguide antennas into an associated RF system which may utilize coaxial type RF energy transmission line. These methods may include coaxial probes, wire loops and printed circuit patches inserted into the waveguide and transitioning to coaxial line external to it. In many cases the coupling mechanism is designed and positioned so that only the dominant $TE_{10}$ mode is excited 1 in the waveguide.

To maximize energy transfer between the coaxial transmission line and the waveguide a conductive shorting wall is typically located one quarter of a guided wavelength ($\lambda_g/4$) in the backward direction from the probe feed. The wave propagating from the probe in this backward direction reflects off the short and back in the forward direction. This reflected wave then combines constructively with the wave travelling in the forward direction directly off the probe.

A wave propagating in one waveguide (the feed waveguide) may be used to feed other waveguides (radiating or other feed waveguides). A feed waveguide may be located behind, and transverse to, a bank of radiating waveguides. Slots cut in the common walls of the feed and fed waveguides may allow the radiation to couple between these waveguides. The phase of any wave reaching a slot may be controlled by adjusting the location and size of the feed and radiating waveguides.

Proof of concept for SWASS construction materials has been validated through test of several variants of composite waveguides sized for maximum performance at approximately 10 GHz. Waveguides were fabricated from various combinations of metal plated and bare carbon fiber which was then resin infused and cured. These samples were then characterized for caparison to a baseline waveguide made with a foil lined interior surface. The waveguides were tested for RF insertion loss among other electrical parameters. FIG. 8 shows sample measured insertion loss data from waveguides fabricated of various material combinations during SWASS development. These constructions, while exhibiting higher insertions loss values than a conventional metal waveguide, are considered acceptable for many antenna applications.

While specific embodiments have been described in detail in the foregoing description and illustrated in the drawings, those with ordinary skill in the art may appreciate that various modifications to the details provided could be developed in light of the overall teachings of the disclosure.

What is claimed is:

1. A slotted waveguide antenna stiffened structure for an aircraft having an aircraft skin, the slotted waveguide antenna stiffened structure including:

a structural stiffening element reinforcing the aircraft skin; the structural element connected to a radio frequency feed source, the source providing energy with electromagnetic bandwidth to;

a slotted waveguide antenna having a plurality of waveguides and slots, the antenna conformal to the aircraft skin and the structural stiffening element, the structural stiffening elements functioning as waveguides for the electromagnetic bandwidth;

a slot sealant enclosing the plurality of slots.

2. The slotted waveguide antenna stiffened structure of claim 1 wherein the slotted waveguide antenna structure is a primary load bearing system for the aircraft.

3. The slotted waveguide antenna stiffened structure of claim 1 wherein the structural stiffening element is a discrete tubular stiffener or a sandwich core.

4. The slotted waveguide antenna stiffened structure of claim 1 further including a collection of slotted waveguides, each waveguide having phase control for beam steering about a transverse axis.

5. The slotted waveguide stiffened structure of claim 4 wherein the slotted waveguide stiffening structure includes a collection of slotted waveguide sub-arrays each having phase control for beam steering about the longitudinal axis.

6. The slotted waveguide stiffened structure of claim 1 wherein the slot sealant has electrical properties that vary between slots for beam steering about the longitudinal axis.

7. The slotted waveguide stiffened structure of claim 1 wherein the waveguide is filled with a dielectric foam.

8. The slotted waveguide stiffened structure of claim 1 wherein the slot sealant is a dielectric.

9. The slotted waveguide stiffened structure of claim 1 wherein the slot sealant fills the plurality of slots.

10. The slotted waveguide stiffened structure of claim 1 wherein the slot sealant covers the plurality of slots.

11. The slotted waveguide stiffened structure of claim 1 wherein the slot sealant is a fiber reinforced laminate.

12. The slotted waveguide stiffened structure of claim 1 wherein the structural stiffening element is a carbon fiber reinforced plastic.

13. The slotted waveguide stiffened structure apparatus of claim 12 wherein the carbon fibers are coated with a metal.

14. The slotted waveguide stiffened structure of claim 1 wherein the plastic included embedded nano fibers.

15. The slotted waveguide stiffened structure of claim 1 wherein the structural stiffening element includes an inner mold line, the inner mold line coated with at least one metal.

16. The slotted waveguide stiffened structure of claim 1 wherein the structural stiffening element comprises metal, carbon fiber composites, or a combination thereof.

17. The slotted waveguide stiffened structure of claim 1 wherein the antenna, the aircraft skin and the structural stiffening element are conformal and aerodynamic.

18. A slotted waveguide antenna stiffened structure for an aircraft having an aircraft skin with an electromagnetic interference, the slotted waveguide antenna stiffening structure including:

a structural stiffening element reinforcing the aircraft skin; the structural element connected to a radio frequency feed source, the source providing energy with electromagnetic bandwidth to;

a slotted waveguide antenna having a plurality of slots, the antenna conformal to the aircraft skin and the structural stiffening element, the structural stiffening elements functioning as waveguides for the electromagnetic bandwidth;

a slot sealant enclosing the plurality of slots, the slot sealant having an electromagnetic interference of less than the aircraft skin electromagnetic interference.

* * * * *